United States Patent [19]

Geis et al.

[11] 4,141,661

[45] Feb. 27, 1979

[54] GUIDE SYSTEM FOR WIRE MATRIX PRINTING

[75] Inventors: David G. Geis, Chicago; Ingard B. Hodne, Northbrook, both of Ill.

[73] Assignee: Teletype Corporation, Skokie, Ill.

[21] Appl. No.: 816,824

[22] Filed: Jul. 18, 1977

[51] Int. Cl.[2] ..... B41J 3/12

[52] U.S. Cl. ..... 400/124; 101/93.05

[58] Field of Search ..... 197/1 R; 101/93.05

[56] References Cited

U.S. PATENT DOCUMENTS

| | | | |
|---|---|---|---|
| 3,333,667 | 8/1967 | Nordin | 197/1 R |
| 3,835,975 | 9/1974 | Howard | 197/1 R |
| 3,893,220 | 7/1975 | Bittner | 197/1 R |
| 3,982,622 | 9/1976 | Billino et al. | 197/1 R |
| 3,994,381 | 11/1976 | Herbert | 101/93.05 |
| 4,009,772 | 3/1977 | Glaser et al. | 197/1 R |
| 4,016,965 | 4/1977 | Wirth et al. | 197/1 R |
| 4,044,878 | 8/1977 | Kunath | 197/1 R |
| 4,061,219 | 12/1977 | Nishikawa et al. | 197/1 R |

FOREIGN PATENT DOCUMENTS

| | | | |
|---|---|---|---|
| 961695 | 1/1975 | Canada | 197/1 R |
| 2119641 | 11/1972 | Fed. Rep. of Germany | 197/1 R |

*Primary Examiner*—Clyde I. Coughenour
*Attorney, Agent, or Firm*—J. C. Albrecht

[57] ABSTRACT

A guide system for arranging a plurality of print wires from a converging arrangement into a parallel arrangement aligned with a column of dot locations to be printed on a record medium, the guide system including a first guide more remote from the record for bearing against the wires as they are bent into a direction perpendicular to the record medium. And a second guide nearer the record medium than is the first guide, for applying the bending force to the wires to bring them into alignment perpendicular to the record medium. A final guide still nearer to the record medium finally assures that the wires are in a straight, columnar line as they face the record medium. The first and second guides are freely movable in a plane substantially perpendicular to the final direction of movement of the wires, thereby accommodating some transient movement of the wire ends and to accommodate unbalanced bending forces of the wires due to an unequal number of wires approaching the guide from each side of the axis of movement of the wire ends.

3 Claims, 3 Drawing Figures

GUIDE SYSTEM FOR WIRE MATRIX PRINTING

FIELD OF THE INVENTION

The present invention relates to wire matrix printing and more particularly to a guide system for aligning the printing wires from converging paths into corresponding paths perpendicular to a record medium for printing thereon.

BACKGROUND OF THE INVENTION

U.S. Pat. No. 3,982,622 granted on Sept. 28, 1976 to J. A. Bellino et al. discloses a matrix printing mechanism in which magnetic mechanisms move printing wires toward and away from a record medium or paper. The staggered wires approach the record medium from two different directions. Bellino et al. use a fixed position, staggered guiding arrangement such that by the time the wires reach the record medium they converge in a single straight columnar line of dots on the record medium.

Such converging arrangements have been found to be unsatisfactory due principally to the difficulty of adjusting the location of the ends of the wires. This is particularly important with a record medium which is tightly curved over a relatively-small-diameter platen. The dots have a tendency to be staggered on either side of a nominal columnar line. The human eye quickly detects such staggering, particularly when it is repeated from character to character. This is found to be esthetically unacceptable.

There are several patents that show bending print wires in a direction into alignment in which the wire approaches the record medium in a perpendicular direction. Such prior art includes U.S. Pat. No. 3,893,220 granted on July 8, 1975, to J. R. Bittner which shows wire guides rigidly molded in place. The R. A. McIntosh U.S. Pat. Nos. 3,991,870 and 3,991,871 both granted on Nov. 16, 1976, show guiding the wires through bent tubular guides to a fixed guide immediately in front of the record medium. U.S. Pat. No. 3,907,092 granted on Sept. 23, 1975, to Kwan et al. shows bending the wires into a converging straight line perpendicular to the record medium. U.S. Pat. No. 3,991,869 granted on Nov. 16, 1976, to H. R. Berrey et al. shows bending the wires into the desired perpendicular arrangement.

SUMMARY OF THE INVENTION

In accordance with the present invention, dot matrix printing wires converge in a printing mechanism which moves the printing wires and guides the printing wires in paths each having a slight angle to a Y direction perpendicular to a record medium, an improved alignment arrangement for guiding wires from their paths at an angle to the Y direction into paths substantially in the Y direction in the vicinity of the record medium comprising, at least a first guide remote from the record medium for bearing against a side of each of the printing wires and in sliding contact with each of the printing wires, said first guide restrained by the printing mechanism from movement in the Y direction but freely movable in at least the X direction and around which the wires are bent toward the Y direction, and a final guide adjacent the record medium fixed in at least the X and Y directions with respect to the printing mechanism for bearing against the side of each of the wires opposite from the side of each wire that bears against the first guide for aligning each of the printing wires in the Y direction; advantageously not relying on the angled convergence of the wires to align their ends in contact with the record medium and minimizing friction and wear that might result from misalignment of the guides if the first guide were fixed with respect to the printing mechanism.

BRIEF DESCRIPTION OF THE DRAWINGS

The present invention will be more readily understood by reference to the following detailed description when considered in conjunction with the accompanying drawings wherein like reference numbers designate the same parts throughout the several views in which.

DETAILED DESCRIPTION

Figure 1:
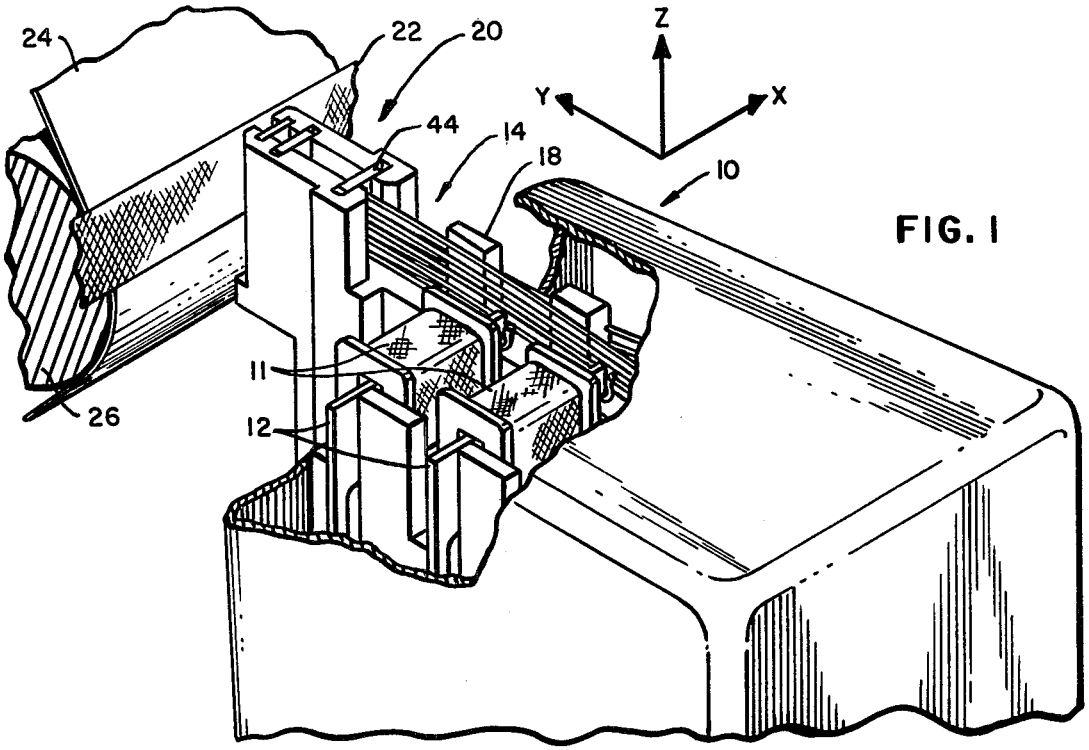
FIG. 1 is a partially cut-away view in perspective of the printing mechanism including a wire guiding system in accordance with the present invention.

Referring now to the accompanying drawings and more particularly to FIG. 1, a three-axis orientation in the X, Y, and Z directions is defined generally in accordance with the orientation system used in the Bellino et al. patent. A printing mechanism 10 is shown with its dust shield partly cut away to expose a pair of print coils 11. The print coils 11 control armatures 12 which control the longitudinal movement of preferably nine print wires 14. The print wires 14 are moved in a direction which is at a slight angle to the Y axis or direction defined in FIG. 1. This angle is preferably on the order of $2\frac{1}{2}°$ for an included angle of 5°. Five wires are located on one side and four wires are located on the other side of a final angle guide block 18. The wires 14 are curved in a gentle but definite arc in a final guiding arrangement 20 which bends the wires 14 so that they strike an inked ribbon 22 in a direction perpendicular to a record medium or paper 24 that is wrapped about a platen 26.

The wires 14, as they strike the ribbon 22, are oriented in a row in the Z direction so as to selectively print a single column of dots on the paper 24. Therefore, the printing mechanism 10 is moved from time to time in the X direction in order to bring the column of wires into proximity with a succession of different column locations on the paper 24. The combination of columns of selectively printed dots forms alphanumeric characters on the surface of the paper 24.

Figure 2:
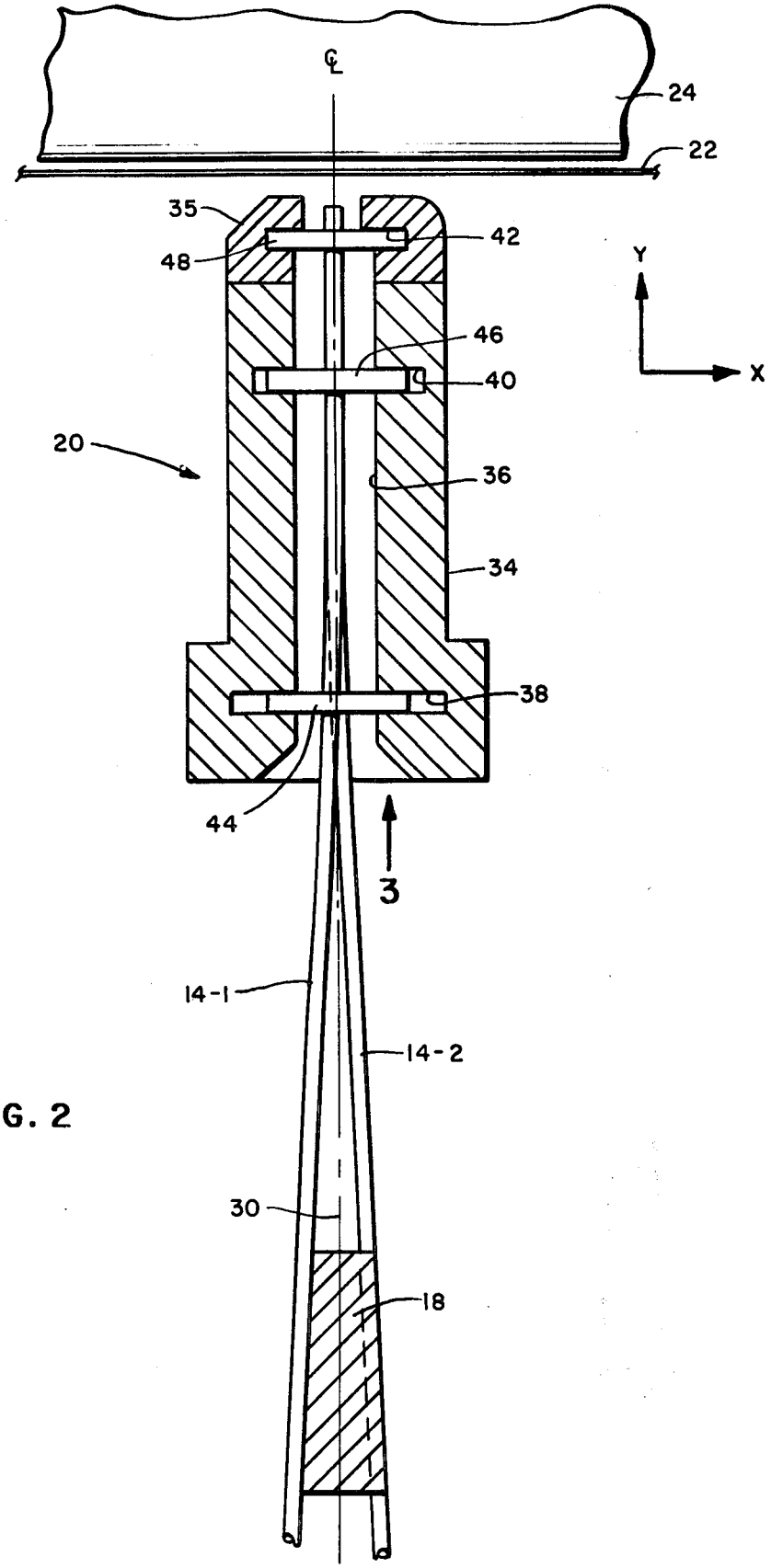
FIG. 2 is a detail greatly enlarged of the final wire guiding system shown in FIG. 1.

Referring now to FIG. 2, the final guiding arrangement 20 is shown greatly enlarged from the illustration of FIG. 1. The X and Y axes are also shown in FIG. 2 for ease of comparison between the various figures of the drawings. Only two of the wires 14 are illustrated in FIG. 2; the upper or top wire 14-1 is shown approaching the final guiding arrangement 20 along a path to the left of the final angle guide block 18 at a slight angle of approximately $2\frac{1}{2}°$ from a centerline 30 that is oriented in the Y direction and is perpendicular to the paper 24. Therefore, there is preferably approximately a 5° included angle between the wires 14-1 and 14-2 as they touch the final angle guide block 18.

The guiding arrangement 20 comprises a frame 34 having a tip piece 35 and a central opening 36 through which the wires 14 can pass. In addition, the frame 34 and its tip piece 35 contain three slots 38, 40, and 42 in which are mounted three guide members 44, 46, and 48, respectively.

As the wire 14-1 approaches the first or upstream guide member 44, the wire 14-1 bears and presses against the final angle guide 18 along the right side of the wire 14-1. Guide member 44 bears against the left side of the wire 14-1 and the guide member 46 bears against the right side of the wire 14-1. These three bearing forces against the wire 14-1 cause the wire to bend in a gentle arc changing its direction through the 2½° of its original direction into an orientation directly on the centerline 30 and exactly perpendicular to the ribbon 22 and paper 24.

The final angle guide block 18 is fixed to the frame of the printing mechanism 10 as is the frame 34. If the forces applied by the wire 14-1 against the guide members 44 and 46 were not somehow opposed, these forces would tend to push the guide member 44 to the left and the guide member 46 to the right. However, the wire 14-2 tends to apply substantially equal and opposite reaction forces to the two guide members 44 and 46.

The wire 14-2 bears on its left side against the final angle guide 18 and presses with its right side against the guide member 44. The wire 14-2 also presses with its left side against the second guide member 46. Since the wires 14-1 and 14-2 are essentially identical except for their angle of approach to the final guiding arrangement 20, the forces which these wires tend to apply to the guides 44 and 46 tend to balance each other and thereby locate the guide members 44 and 46 in approximately the center of their respective slots 38 and 40.

As mentioned above, nine wires are used in the printing mechanism disclosed herein. Consequently, five wires bear on one side (the left side in FIG. 2) of guide member 44 and only four wires are pushing the guide member 44 to the right. Therefore, in order to balance the resulting uneven net reaction force, the guide member 44 assumes a position slightly to the left of center, as viewed in FIG. 2. However, this migration is rather slight, and the guide member serves the purpose of keeping all of the forces on the wires well within an acceptable range. Similarly, the second guide member 46 tends to reach equilibrium somewhat to the right of a nominal center position, which tends to minimize the leftward migration of guide member 44.

It can be seen that by making the guide members 44 and 46 movable in the X direction, the guides become self aligning. This has great advantage in reducing the cost and increasing the ease of assembly of the guiding system for these wires. It also greatly facilitates the optimum positioning of these guide members since the wires themselves position the guides rather than a human assembler or even a machine assembler arbitrarily locating the guide members near some nominal location with some tolerance. Therefore, the optimal positioning of the guides is achieved, thereby minimizing excess friction and wear that would result from misalignment. The guide members 44 and 46 are really very close to each other and just a few thousandths of an inch of misalignment of these two guide members would greatly increase the forces applied to the wires 14 over such very short lengths of wire. High bearing forces due to misalignment would greatly accelerate the wear experienced by the wires and the guide members during operation, which would greatly reduce the life of the printing mechanism. Consequently, making the guide members 44 and 46 floating and self-aligning has the added advantage of minimizing the forces to barely those necessary to bend the wires into the desired direction along the centerline 30.

After the wires issue from the second guide member 46, they pass through a final, fixed guide member 48 prior to exiting from the final guiding arrangement 20. Each wire presses substantially on the same side of the guide member 48 as it pressed against the guide member 46. The slot 42 is no wider than the width of the final guide member 48; thereby preventing the final guide member 48 from moving in the X direction with respect to the print mechanism 10.

The final guide member 48 is shown mounted within the tip piece 35 of the frame 34. The tip piece 35 is preferably clipped to the frame 34 or may be bonded thereto or may actually be an integral part thereof.

Because each wire bears with the same side against both the guide members 46 and 48, all three guide members 44, 46, and 48 can very desirably be made identical and preferably of a very hard material such as synthetic sapphire or ceramic, so as to minimize wear and increase longevity of the mechanism.

Since only the final guide member 48 is fixed with respect to the printing mechanism 10, if the end of one of the wires 14 facing the record medium 24 should be snagged during assembly, disassembly, maintenance, or operation, that end is capable of slightly yielding by reason of the free floating nature of the guide members 44 and 46. Such yielding capability reduces the chances of breakage or damage to the wires or the guide members.

Figure 3:
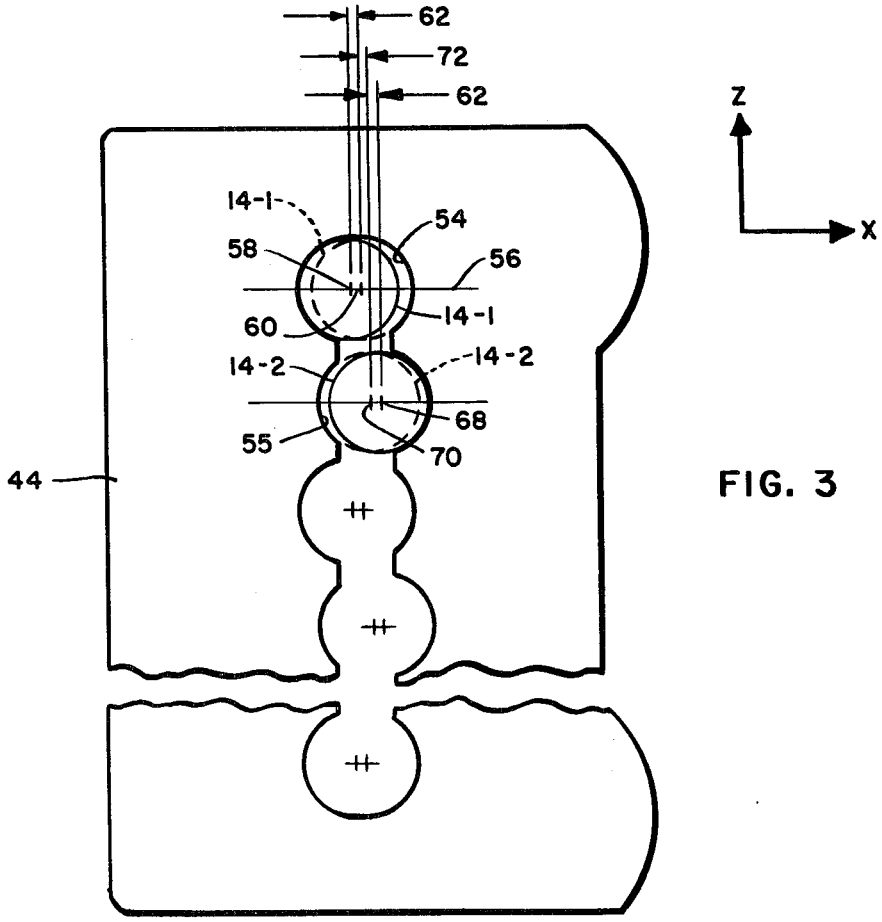
FIG. 3, located on the same sheet as FIG. 1, shows a single wire guide oriented to be viewed generally from a direction of the arrow labelled 3 in FIG. 2 and greatly enlarged from the size shown in FIG. 2.

Referring now to FIG. 3, one of the identical guide members 44, 46, or 48 is shown greatly enlarged. The guide member is referred to in FIG. 3 by the reference number 44 and contains a plurality of linked openings that are staggered on alternate sides of a nominal center. The top wire 14-1 is illustrated in place in the top opening 54 of the guide member 44 in FIG. 3. As viewed in FIG. 3, that top wire 14-1 bears against the left side of the top opening 54 of the guide member 44. This applies a force in the X direction to the right against the side of a top wire 14-1. This force tends to cause the wire 14-1 to bend in a gentle arc so as to change from a 2½° angle to the centerline 30 (FIG. 2) and to bend the wire so as to lie along the centerline 30. Similarly, the second wire 14-2 which approaches the centerline 30 from the right (FIG. 2) is shown (in FIG. 3) bearing against the right side of the second opening 55 in the guide member 44.

While the openings that are linked together in a vertical line along the height of the guide member 44 of FIG. 3 appear at first glance to be circles, they are preferably elongated circles but may also be round. The top opening 54 is actually formed of two radii that are centered at two different points along an axis 56. The left side of the top opening 54 is formed with a radius about a center 58 on the axis 56, while the right side of the opening 54 is formed with a radius about a center 60 on the axis 56.

The center 58 is separated from the center 60 by a distance 62 which is intended to accommodate the arc formed by the 14-1 as it bends through the requisite 2½°. Therefore, the left half of the opening 54 is extended far enough to the left to define the arc of curvature of the wire 14-1 as it turns through the 2½° that it originally deviated from the centerline 30. This bending distance 62 is readily calculable from the distances between the final angle guide block 18, the guide member 44, and the guide member 46.

The radii of the surfaces of the opening 54 are just slightly larger than the radius of the wire 14-1. Actually, the difference in radii between the wire and the opening 54 are merely the tolerances of the minimum production radius with which the guide member 44 is made and the largest radius with which the wire 14-1 is made.

Similarly, the second wire 14-2 bears against the right side of the second opening 55 which defines the arc of curvature of the wire 14-2 to bend the wire through the 2½° by which the wire 14-2 deviates from the centerline 30. Since the wire 14-1 approaches the guide member from the left, it bears against the left side of the opening 54. Conversely, the wire 14-2 bears against the right side of the opening 55, because it approaches the guide member 44 from the right side.

The wires 14-1 and 14-2 are also shown in dotted lines in FIG. 3. These dotted lines represent the orientation of the wires 14-1 and 14-2 as they engage the guide members 46 and 48. Thus the wire 14-1 in dotted lines engages the right-hand side of the opening 54 in the guide member 46 (it being remembered that the guide members 44, 46, and 48 are identical). Similarly, the wire 14-2 shown in dotted lines in FIG. 3 bears against the left side of the opening 55 in the guide member 46. It is to be noted that the right portion of the opening 55 is formed of an arc with a radius about a center 68, while the left side of the opening 55 is formed of an arc about a center 70. As in the case of the opening 54, the distance between the center 68 and 70 represents approximately the bending of the wire 14-2 and is also shown by the reference number 62 in FIG. 3.

It will also be noted that the center 60 is not quite aligned with the center 70. The purpose of this misalignment is to assure that when the wire 14-1 rests against the right-hand side of the opening 54 in the final fixed guide member 48, the center of the wire 14-1 will be directly in vertical line with the center of the wire 14-2 as it engages the left-side of the opening 55 in the final guide member 48. Therefore, the centers 60 and 70 are separated by a distance 72 that is related to the tolerance of the diameters of the wires 14.

Although only one specific embodiment of the invention is shown in the drawings, and described in the foregoing specification, it will be understood that invention is not limited to the specific embodiment described, but is capable of modification and rearrangement and substitution of parts and elements without departing from the spirit and scope of the invention.

What is claimed is:

1. In a mechanical dot matrix printer in which printing wires are moved relative to a record medium for mechanically marking indicia thereon, a printing mechanism for printing indicia in an X direction comprising: means for moving the printing wires in a direction nearly in a Y direction perpendicular to the X direction for marking indicia on the record medium, said wires in the vicinity of the record medium being arranged seriatim in a Z orientation perpendicular to the X and Y directions, and means for guiding the wires in paths each having a slight angle to the Y direction and generally toward the record medium; an improved alignment arrangement for guiding the wires from their paths at an angle to the Y direction into paths substantially in the Y direction in the vicinity of the record medium comprising:

a frame firmly attached to the printing mechanism;

at least a first guide remote from the record medium for bearing against a side of each of the printing wires and in sliding contact with each of the printing wires, and containing guiding surfaces bearing against the wires which guiding surfaces are substantially in the shape of the surfaces of the wire and are alternately misaligned to accommodate alternate wires approaching the guide from opposite sides on each side of the Y direction, said first guide restrained by the frame from movement in the Y direction but freely movable in at least the X direction and around which the wires are bent toward the Y direction; and a final guide identical to the first guide and located adjacent the record medium fixed in at least the Y and X directions with respect to the frame for bearing against the side of each of the wires opposite from the side of each wire that bears against the first guide for aligning each of the printing wires in the Y direction.

2. In a mechanical dot matrix printer in which print wires are moved relative to a record medium for mechanically marking indicia thereon, a printing mechanism for printing indicia in an X direction comprising: means for moving the wires in a Y direction substantially perpendicular to the X direction for marking indicia on the record medium, said wires in the vicinity of the record medium being arranged seriatim in a Z orientation perpendicular to the X and Y directions, and means for guiding the wires in paths each having a slight angle to the Y direction and generally toward the record medium; an improved alignment arrangement for guiding the wires from their paths at an angle to the Y direction into paths substantially in the Y direction in the vicinity of the record medium comprising:

a first guide in sliding contact with each of the printing wires, said first guide freely movable in the X direction and around which the wires are bent toward the Y direction, the first guide containing guiding surfaces bearing against the wires which guiding surfaces are substantially in the shape of the surfaces of the wire and are alternately misaligned to accommodate alternate wires approaching the guide from opposite sides on each side of the Y direction;

a second guide means identical to the first guide and also freely movable in the X direction also for bending the wires toward the Y direction; and a final guide fixed with respect to the printing mechanism for finally guiding the wires in the Y direction.

3. A system according to claim 2 wherein the final guide means is identical to the second guide.

* * * * *